US010508372B2

(12) United States Patent
Aylor et al.

(10) Patent No.: US 10,508,372 B2
(45) Date of Patent: Dec. 17, 2019

(54) SYSTEMS AND METHODS FOR APPLYING TENSION TO BACKING MATERIALS FOR TUFTED PRODUCTS

(71) Applicant: COLUMBIA INSURANCE COMPANY, Omaha, NE (US)

(72) Inventors: Kyle Andrew Aylor, Cartersville, GA (US); Wesley Coleman Tincher, Calhoun, GA (US)

(73) Assignee: COLUMBIA INSURANCE COMPANY, Omaha, NE (US)

( * ) Notice: Subject to any disclaimer, the term of this patent is extended or adjusted under 35 U.S.C. 154(b) by 112 days.

(21) Appl. No.: 15/863,020

(22) Filed: Jan. 5, 2018

(65) Prior Publication Data

US 2018/0195221 A1 Jul. 12, 2018

Related U.S. Application Data

(60) Provisional application No. 62/442,711, filed on Jan. 5, 2017.

(51) Int. Cl.
*D05C 15/14* (2006.01)
*B65H 23/188* (2006.01)

(52) U.S. Cl.
CPC ..... *D05C 15/14* (2013.01); *B65H 23/1888* (2013.01); *B65H 2404/152* (2013.01); *B65H 2408/217* (2013.01)

(58) Field of Classification Search
CPC . D05C 5/14; D05C 5/28; D05C 17/02; B65H 23/188; B65H 23/1888;
(Continued)

(56) References Cited

U.S. PATENT DOCUMENTS 2,784,688 A * 3/1957 Ebersold ..... D05C 15/00 112/80.3
2,818,037 A 12/1957 McNutt
(Continued)

OTHER PUBLICATIONS

International Search Report and Written Opinion dated Mar. 26, 2018 by the International Searching Authority for Application No. PCT/US2018/012492, which was filed on Jan. 5, 2018 (Inventor-Aylor et al.; Applicant-Shaw Industries Group, Inc.; (16 pages).
(Continued)

*Primary Examiner* — Ismael Izaguirre
(74) *Attorney, Agent, or Firm* — Ballard Spahr LLP

(57) ABSTRACT

Systems and methods for pre-tensioning backing materials of a tufted product. The systems can include at least first and second tensioning assemblies and a guide assembly. Each tensioning assembly can have a backing supply subassembly for supporting a backing material and a roller subassembly for effecting movement of the backing material at a desired tension. The roller subassembly can include a driven roller for pulling the backing material from the backing supply subassembly, and a compensator for receiving the backing material from the driven roller. The guide assembly can simultaneously receive the tensioned backing materials from the tensioning assemblies and position the backing materials in contact with each other for delivery to a tufting machine at the desired tension.

20 Claims, 14 Drawing Sheets

(58) Field of Classification Search
CPC ..... B65H 23/1955; B65H 2404/152; B65H 2404/16; B65H 2404/167; B65H 2408/217; B65H 2408/20; B65H 2408/21; B65H 2408/213; B65H 2408/214
See application file for complete search history.

(56) References Cited

U.S. PATENT DOCUMENTS 3,847,692 A * 11/1974 Bondi ..... D03C 3/20 156/72
3,960,095 A * 6/1976 Story ..... D05B 11/00 112/118
4,069,775 A * 1/1978 Bryant ..... D05C 15/18 112/80.01
4,622,044 A * 11/1986 Nichols, Jr. ..... D06B 11/0063 8/151
5,603,270 A * 2/1997 White ..... D05B 11/00 112/117
5,809,917 A 9/1998 McGowan et al.
5,962,101 A 10/1999 Irwin, Sr. et al.
5,989,368 A * 11/1999 Tillander ..... B32B 38/1833 156/363
6,475,592 B1 11/2002 Irwin
6,588,641 B2 * 7/2003 Prittie ..... B65H 20/02 226/117
6,782,838 B1 8/2004 Segars et al.
7,216,598 B1 5/2007 Christman, Jr.
7,359,761 B1 4/2008 Christman, Jr.
2014/0000497 A1 1/2014 Modra

OTHER PUBLICATIONS

U.S. Appl. No. 62/442,711, filed Jan. 5, 2017, K.A. Aylor et al. (Columbia Insurance Co.).
PCT, PCT/US2018/012492, Jan. 5, 2018, K.A. Aylor et al. (Shaw Industries Group, Inc.).

* cited by examiner

SYSTEMS AND METHODS FOR APPLYING TENSION TO BACKING MATERIALS FOR TUFTED PRODUCTS

CROSS-REFERENCE TO RELATED APPLICATION

This application claims priority to U.S. Provisional Application No. 62/442,711, filed Jan. 5, 2017. The disclosure of the above-referenced application is hereby incorporated herein by reference in its entirety.

FIELD

The disclosed invention relates to systems and methods for pre-tensioning backing materials for tufted products.

BACKGROUND

During the manufacture of tufted products, such as carpet or turf, a roll of primary backing material can be supplied from a supply roll and continuously fed through a tufting machine. The tufting machine can be provided with a reciprocating needle bar having a series of spaced tufting needles disposed on the tufting machine for insertion of tufts into the backing material. Due to the inherent ability of backing material to stretch, the tension in the backing material naturally varies during operation of the tufting machine based on the weight of the backing material present on the roll at any given time. For instance, as the roll of backing material gradually decreases in diameter, the tension across the backing material also decreases. As can be appreciated by one of ordinary skill in the art, different types of backing materials have different corresponding tensile strengths, and as a result, the tension can also vary with the type of backing material used. Such changes in tension can create backing wrinkles (pleats), stitch rate and stitch density variations, pattern variations, and measurement errors, leading to increases in waste and manufacturing costs while simultaneously causing decreases in quality and customer service.

Previous systems and methods have attempted to pre-stretch a primary backing material as it is fed into the tufting zone of the tufting machine such as through use of a spiked roller connected to a gearbox/motor combination, which controlled two primary backing rolls at the same time by setting a resistance on a potentiometer. However, such systems and methods are ineffective at maintaining tension in a backing material being fed to a tufting machine, particularly for those processes requiring more than one type or layer of primary backing material.

Thus, there is a need for systems and methods that eliminate or reduce the backing wrinkles (pleats), stitch rate or stich density inconsistencies, pattern variations, and measurement errors associated with existing processes for manufacturing tufted products, particularly tufted products having multiple backing layers.

SUMMARY

Described herein, in various aspects, is a system for pre-tensioning backing materials of a tufted product. The system can comprise at least first and second tensioning assemblies and a guide assembly. Each tensioning assembly can comprise a backing supply subassembly configured to support a backing material, and a roller subassembly having a driven roller and a compensator. The driven roller can be configured to pull the backing material from the backing supply subassembly, and the compensator can be configured to receive the backing material from the driven roller. The roller subassembly can be configured to maintain a desired tension of the backing material. The guide assembly can be configured to simultaneously receive the tensioned backing materials from the first and second tensioning assemblies. The desired tension of the backing material exiting the first tensioning assembly can be equal, substantially equal, or unequal to the desired tension of the backing material exiting the second tensioning assembly, and the guide assembly can be configured to position the tensioned backing materials in contact with each other. Also described herein are methods of using the disclosed system and a tufting apparatus that includes the disclosed system and a tufting machine.

Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DESCRIPTION OF THE DRAWINGS

These and other features of the preferred embodiments of the invention will become more apparent in the detailed description in which reference is made to the appended drawings wherein.

DETAILED DESCRIPTION

Figure 1A:
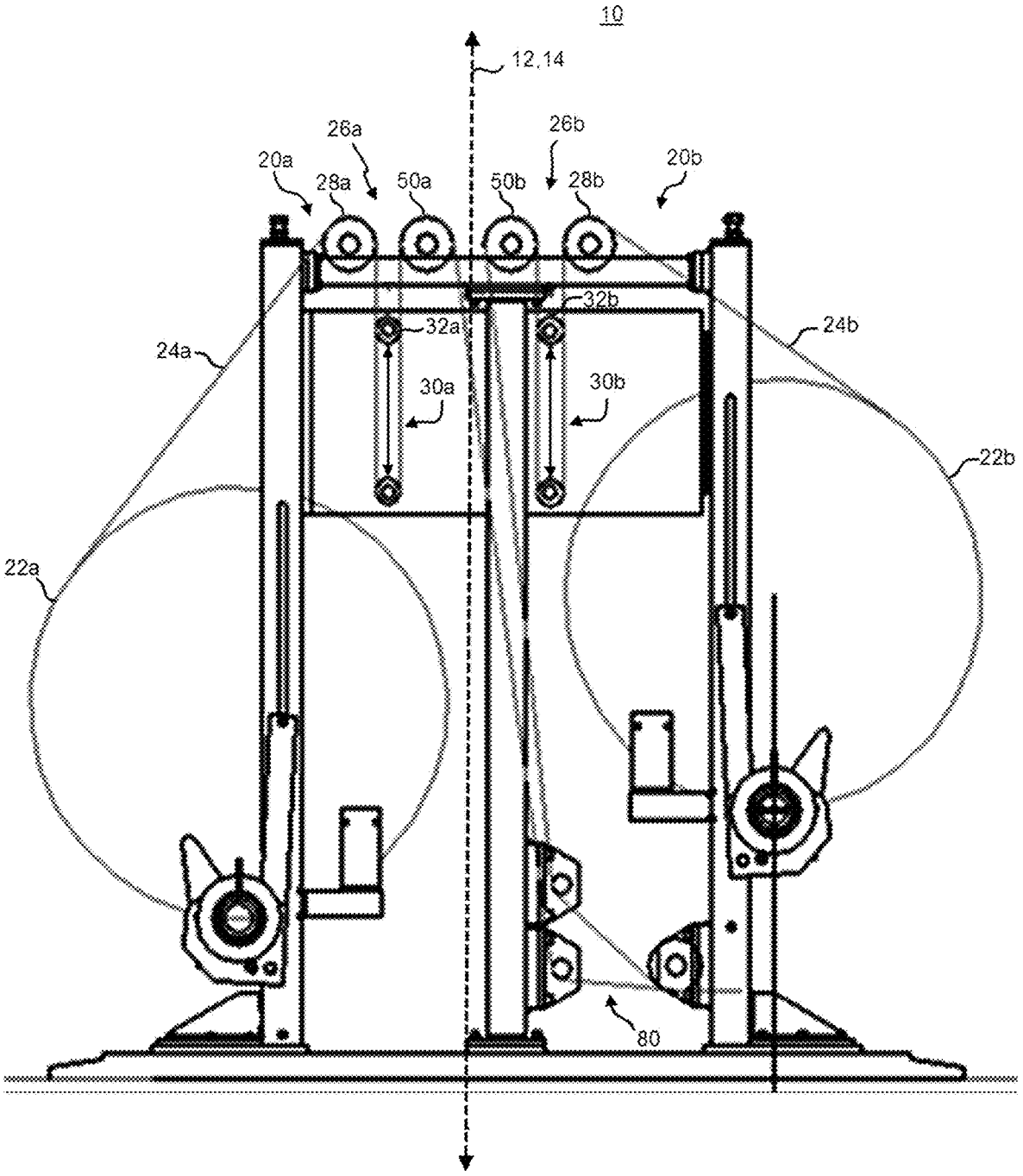
FIG. 1A is a cross-sectional side view of an exemplary system for pre-tensioning backing materials as disclosed herein. As depicted, the system can comprise driven rollers (e.g., dual pin roller drives) and compensators (e.g., dancers) that cooperate to control the tension applied to the primary backing materials.

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout. It is to be understood that this invention is not limited to the particular methodology and protocols described, as such may vary. It is also to be understood that the terminology used herein is for the purpose of describing particular embodiments only, and is not intended to limit the scope of the present invention.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

As used herein the singular forms "a", "an", and "the" include plural referents unless the context clearly dictates otherwise. For example, use of the term "a roller" can refer to one or more of such rollers, and so forth.

All technical and scientific terms used herein have the same meaning as commonly understood to one of ordinary skill in the art to which this invention belongs unless clearly indicated otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. Optionally, in some aspects, when values are approximated by use of the antecedent "about," it is contemplated that values within up to 15%, up to 10%, or up to 5% (above or below) of the particularly stated value can be included within the scope of those aspects. Similarly, in some optional aspects, when values are approximated by use of the term "substantially" or "substantially equal," it is contemplated that values within up to 15%, up to 10%, or up to 5% (above or below) of the particular value can be included within the scope of those aspects. Optionally, the use of the term "unequal" can refer to values that vary from one another by more than 15%.

As used herein, the terms "optional" or "optionally" mean that the subsequently described event or circumstance may or may not occur, and that the description includes instances where said event or circumstance occurs and instances where it does not.

The word "or" as used herein means any one member of a particular list and also includes any combination of members of that list.

The term "tufted product" is used herein in the manner as would be recognized by one of ordinary skill in the art. The definition of "tufted product" as used herein includes any product that can be formed from a tufted material, including, for example and without limitation, carpets, carpet tiles, rugs, mats, turf products, and the like.

The term "backing material" as used herein includes both primary backing materials and secondary backing materials. The term "backing material" refers to any conventional backing material that can be applied to a tufted product, such as a woven, a non-woven, a knitted, a needle punched fabric, as well as a stitch bonded primary backing material. As one skilled in the art will appreciate, materials such as polypropylene, polyesters, hemp, composites, blend, nylons, or cottons can be used to form the backing material.

As used herein, the term "communicatively coupled" refers to any wired or wireless communication arrangement as is known in the art. Such wired or wireless communication can be direct (between two components) or can be indirect (via an intermediate component). Exemplary communication arrangements include servo motors that are connected to a controller or processor in a wireless or wired manner, as well as network-based arrangements in which components communicate using a WiFi, cellular, or other communication network.

The following description supplies specific details in order to provide a thorough understanding. Nevertheless, the skilled artisan would understand that the apparatus, system, and associated methods of using the apparatus can be implemented and used without employing these specific details. Indeed, the apparatus, system, and associated methods can be placed into practice by modifying the illustrated apparatus, system, and associated methods and can be used in conjunction with any other apparatus and techniques conventionally used in the industry.

Disclosed herein, in various aspects and with reference to FIGS. 1A-11B, is a system and method for pre-tensioning backing materials of a tufted product. The disclosed system 10 is configured to maintain a constant tension on at least first and second backing materials (e.g., primary backing rolls) positioned on respective dual backing stands prior to delivery of the backing materials to a tufting machine. Thus, in contrast to previous attempts to control multiple backings, the disclosed system relies upon multiple tensioning assemblies that provide tension to corresponding backing materials and cooperate with each other to concurrently provide multiple backing materials at desired relative tensions. The system offers linear tension control during the tufting process and is capable of maintaining a constant tension regardless of the size of the backing materials. For example, as the first and second backing materials come together at a desired tension (e.g., equal, substantially equal, or unequal tension), as will be further described herein, the system can ensure that the layers of the backing materials lay flat without puckering. Such constant tensioning of the backing materials can result in a reduction of primary backing wrinkles (pleats) in the tufting process and an improvement in tufted roll length accuracy and consistency in stitch rate and stitch density. The reduction of primary backing wrinkles and the improvement in roll length accuracy and consistency in stitch rate and stitch density can reduce manufacturing costs and waste and improve customer service, product quality, and product installation.

As further disclosed herein, the system can use a series of rollers, motors, motor controllers, lasers, bearings, and an electronic control system to maintain desired (optionally, constant) tensions in the first and second backing materials during the tufting process. The system can work by advancing each backing material through a separate series of rollers, including driven rollers (e.g., pin/spike rollers), idler rollers, and compensators (e.g., a floating "dancer" roller such as a hollow tube) to maintain a desired (optionally, constant) tension in the backing materials (as the backing materials are advanced to the tufting machine) using the electronic control system. The electronic control system can (a) measure the position of the compensator (or a bearing mounted about the compensator) relative to a vertical axis (e.g., using a laser rangefinder or other suitable sensor) and (b) based upon the position of the compensator, speed up or slow down the speed of the driven roller through the motor controllers to thereby control the tension of each backing material.

Referring now to FIGS. 1A-1B and 8A-9B, in exemplary aspects, the system 10 can comprise at least first and second tensioning assemblies 20*a*, 20*b*. In these aspects, it is contemplated that the first and second tensioning assemblies 20*a*, 20*b* can be arranged symmetrically about a plane 14 containing a vertical axis 12 and extending along the longitudinal lengths of the tensioning assemblies (e.g., along the lengths of backing supply rolls as further disclosed herein). Optionally, however, it is also contemplated that the first and second tensioning assemblies 20*a*, 20*b* can be arranged asymmetrically about the plane 14 relative to the vertical axis 12, if desired. In further aspects, each tensioning assembly 20*a*, 20*b* can comprise a respective backing supply subassembly 22*a*, 22*b* configured to support a backing material 24*a*, 24*b* (e.g., a supply roll as is known in the art). In these exemplary aspects, the first and second tensioning assemblies 20*a*, 20*b* can operate concurrently to maintain a constant tension in the respective backing materials 24*a*, 24*b* as the backing materials are advanced to the tufting machine, as further disclosed herein. While the present disclosure provides a detailed description of the system 10 as having first and second tensioning assemblies 20*a*, 20*b*, it is to be understood that the disclosed system is not limited to having only two tensioning assemblies. As would be appreciated by one of ordinary skill in the art, the disclosed system 10 can comprise a plurality of tensioning assemblies 20, which can include any number of tensioning assemblies including, for example, three or more tensioning assemblies. Irrespective of the number of tensioning assemblies 20 provided, it is to be understood that the disclosed system 10 can be modified, as needed, to accommodate the particular number of tensioning assemblies incorporated into the system. For example, each tensioning assembly 20 of the plurality of tensioning assemblies can comprise a respective backing supply subassembly 22 configured to support a backing material 24. Optionally, it is contemplated that a vertical position of each backing supply subassembly 22*a*, 22*b* can be selectively adjusted using conventional methods.

Figure 3:
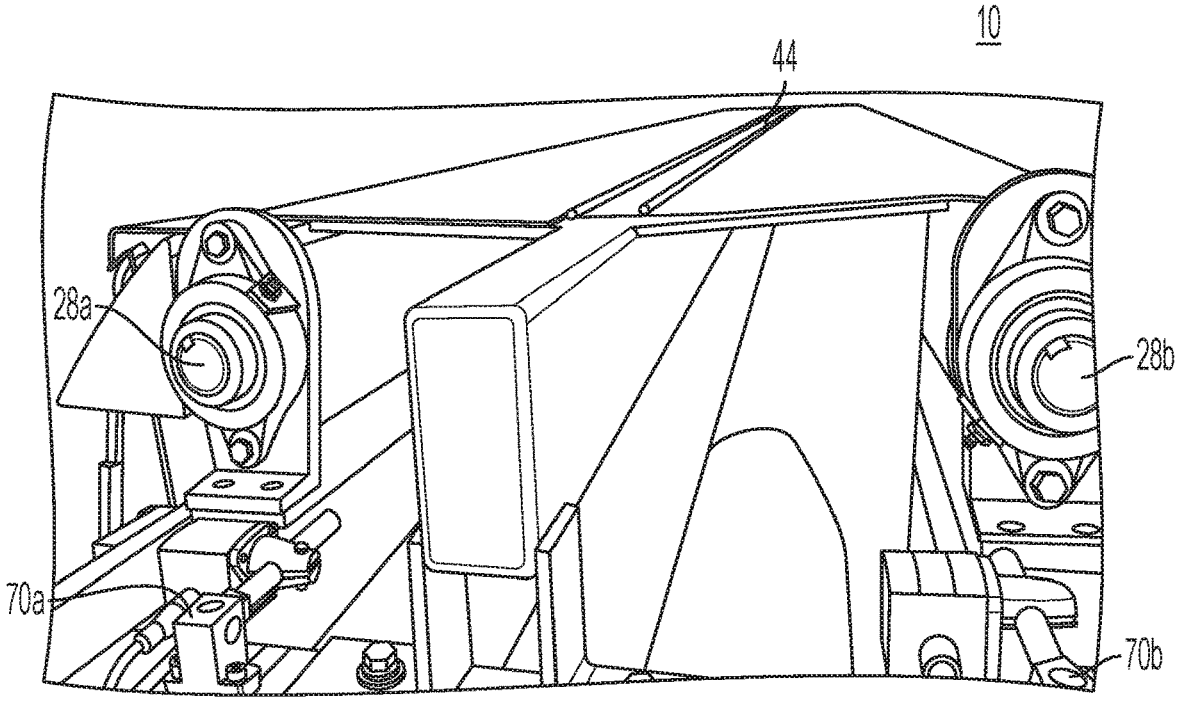
FIG. 3 is an image providing a side view of exemplary driven rollers (e.g., dual pin rollers), dancer lasers, and a safety guard of an exemplary system for pre-tensioning backing materials, as disclosed herein.
Figure 6:
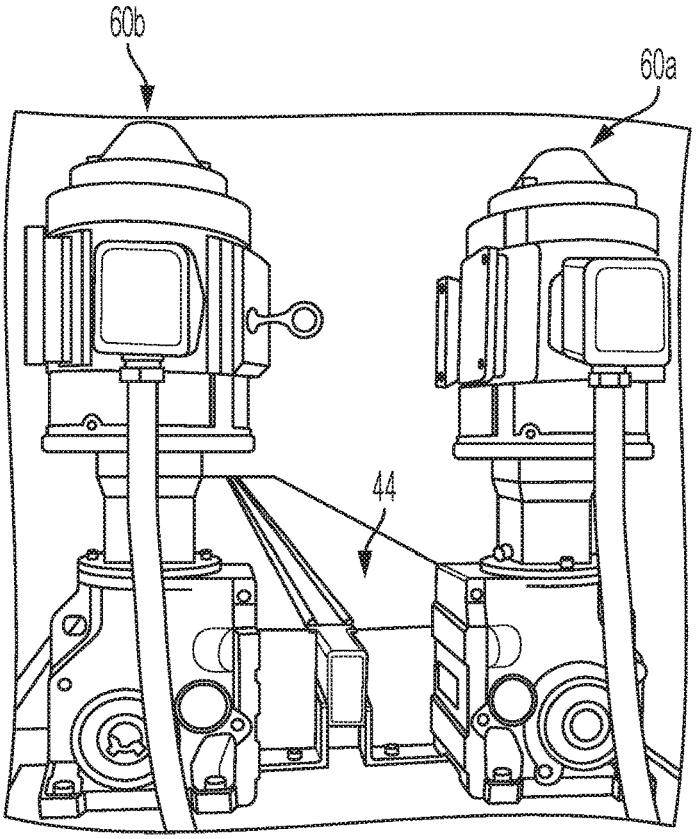
FIG. 6 is an image depicting exemplary drive gearboxes and motors for a driven roller (e.g., a dual pin roller) arrangement, as disclosed herein.
Figure 7:
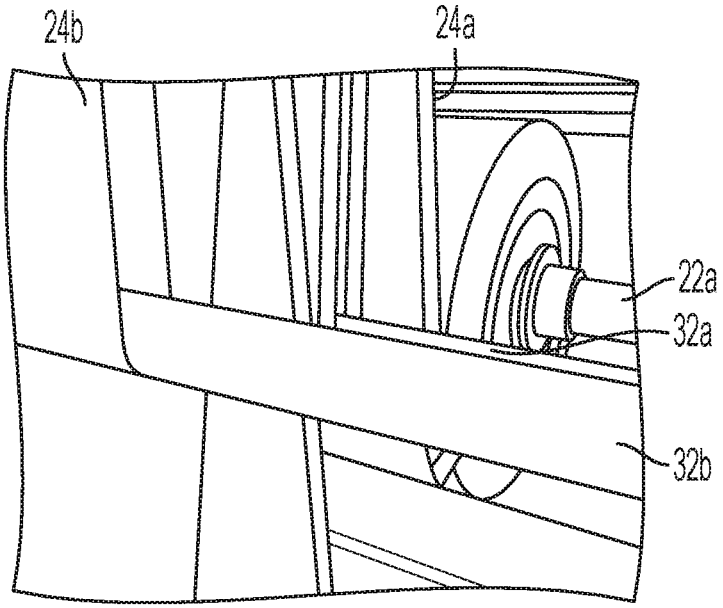
FIG. 7 is a close-up image of compensators (e.g., dual-control dancers) of an exemplary system for pre-tensioning backing materials, as disclosed herein.
Figure 8A:
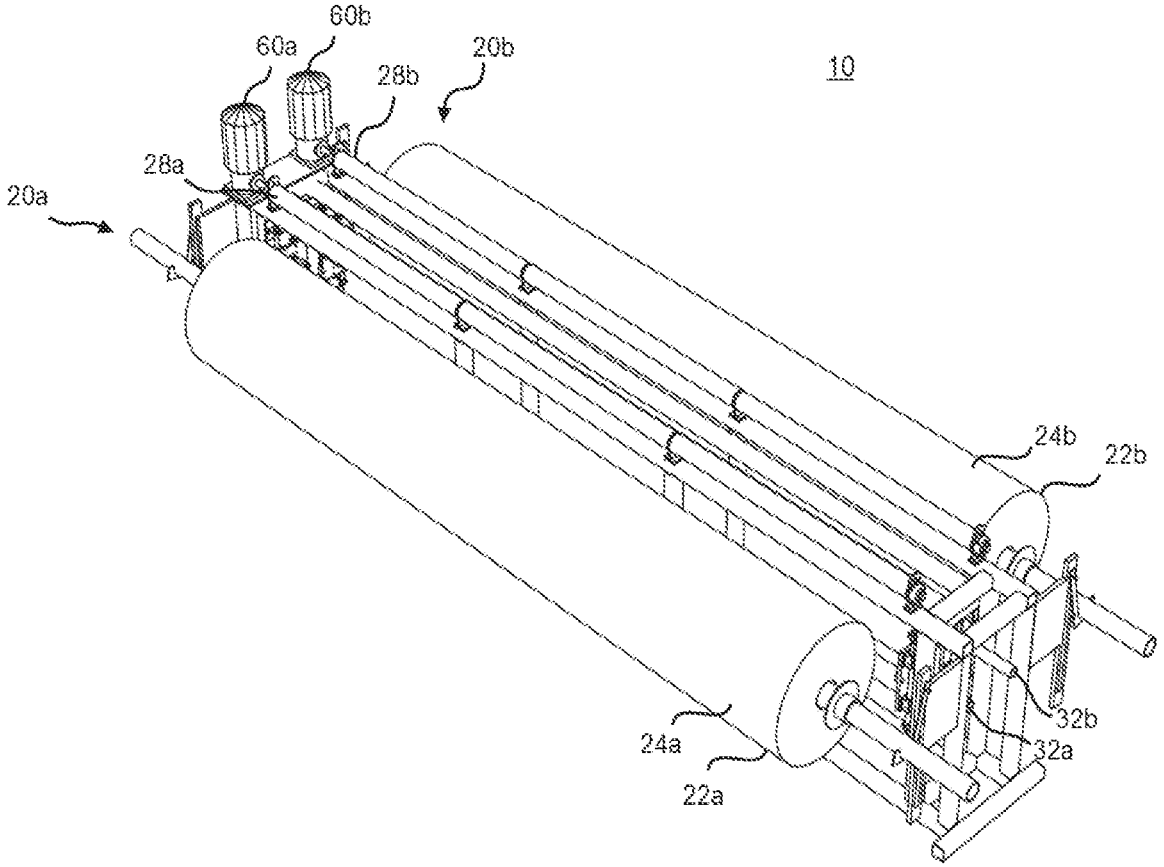
FIG. 8A is a front perspective view of an exemplary system for pre-tensioning backing materials, as disclosed herein.
Figure 8B:
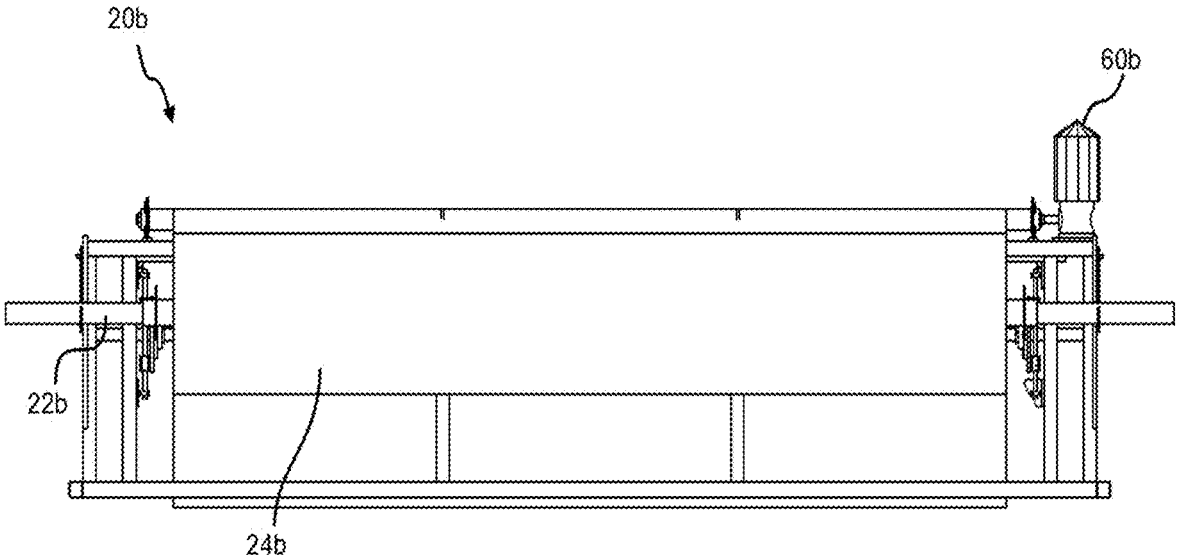
FIG. 8B is a rear view of the exemplary system for pre-tensioning backing materials of FIG. 8A, as disclosed herein.
Figure 8C:
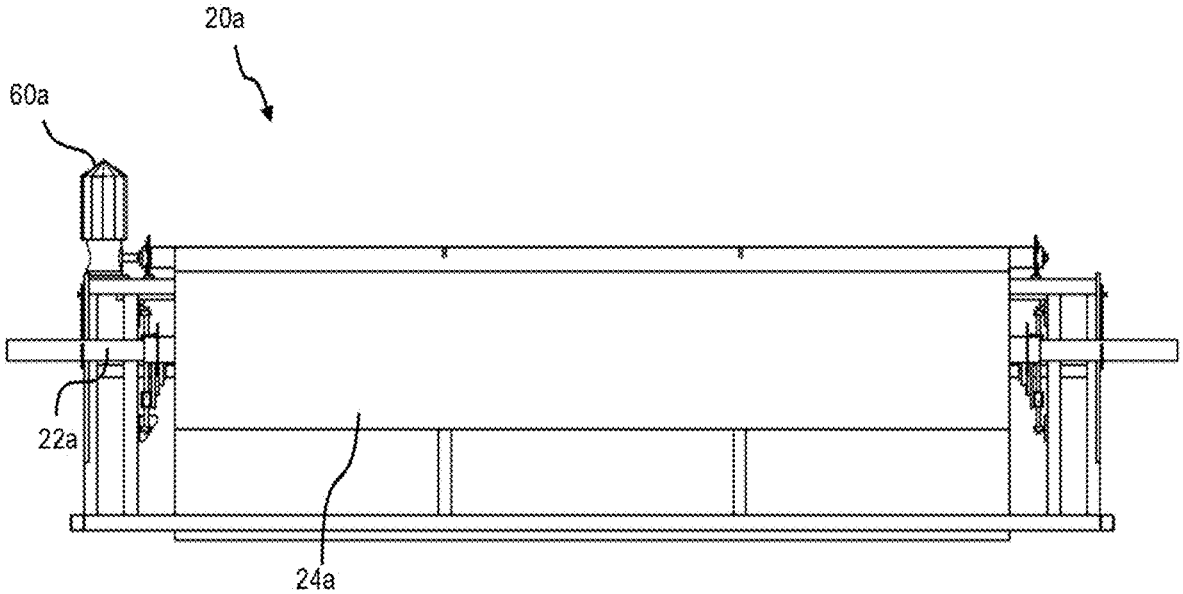
FIG. 8C is a front view of the exemplary system for pre-tensioning backing materials of FIG. 8A, as disclosed herein.
Figure 8D:
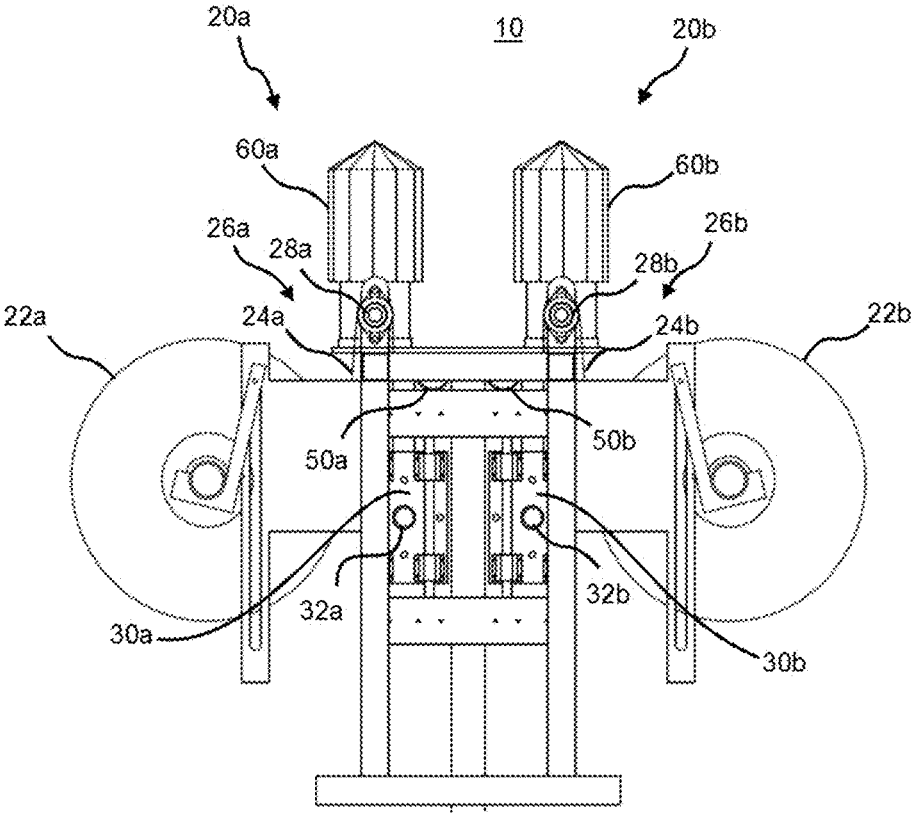
FIG. 8D is a left side view of the exemplary system for pre-tensioning backing materials of FIG. 8A, as disclosed herein.
Figure 8E:
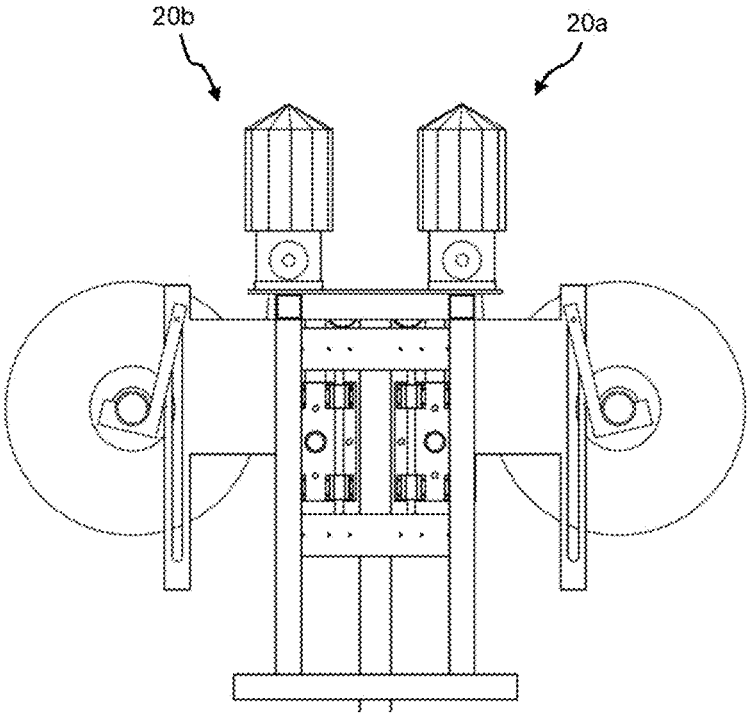
FIG. 8E is a right side view of the exemplary system for pre-tensioning backing materials of FIG. 8A, as disclosed herein.
Figure 8F:
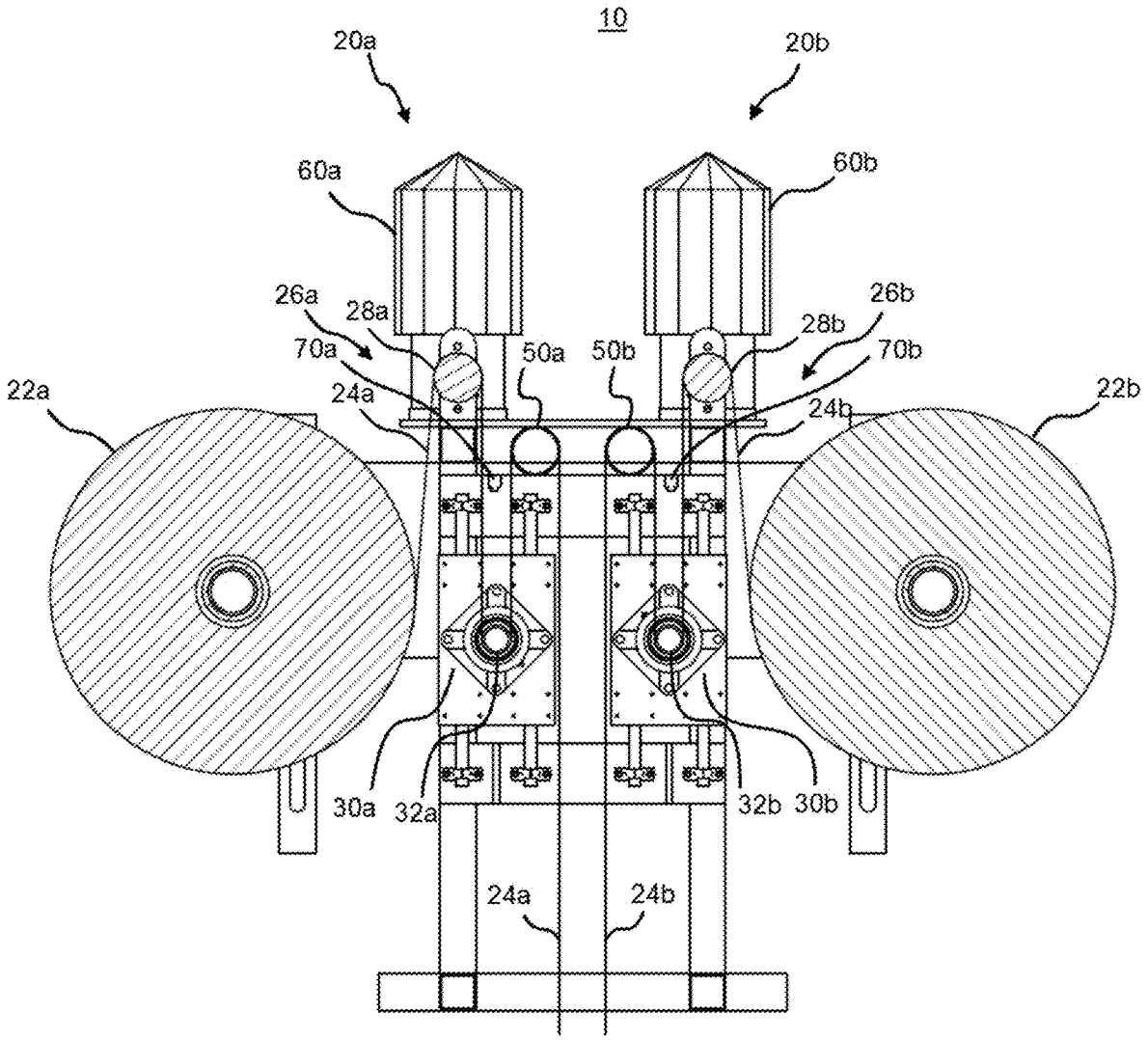
FIG. 8F is a cross-sectional side view of the exemplary system for pre-tensioning backing materials of FIG. 8A, showing the backing material as it passes through the exemplary system, as disclosed herein.

In one exemplary aspect, each tensioning assembly 20*a*, 20*b* can comprise a roller subassembly 26*a*, 26*b* configured to effect movement of the respective backing materials 24*a*, 24*b*. It is contemplated that each roller subassembly 26*a*, 26*b* can comprise a series of rollers that can cooperate with each other to maintain a desired tension of the backing materials 24*a*, 24*b*. In one aspect, each roller subassembly 26*a*, 26*b* can include a driven roller 28*a*, 28*b* (e.g., pin/spike roller) positioned downstream of the respective backing supply subassembly 22*a*, 22*b* and configured to pull the backing material 24*a*, 24*b* from the backing supply subassembly. As used herein, the term "downstream" refers to a direction moving away from the backing supply subassembly and toward a tufting machine as disclosed herein, whereas the term "upstream" refers to a direction moving away from the tufting machine and toward a backing supply subassembly. As shown in FIG. 3, each driven roller can be concentrically mounted about a drive shaft. Also shown in FIG. 3, the driven rollers 28*a*, 28*b* can be shielded by a guard assembly 44 extending across the top length of the driven rollers and mounted to a frame of the tufting apparatus 100, as further described herein. Each driven roller 28*a*, 28*b* can be independently driven by a respective motor 60*a*, 60*b*. As depicted in FIGS. 2A and 8A-8F, the motors 60*a*, 60*b* can be coupled to the driven rollers 28*a*, 28*b* of the first and second tensioning assemblies 20*a*, 20*b*, respectively. Optionally, it is contemplated that the motors 60*a*, 60*b* can be positioned within respective motor housings 62*a*, 62*b*, as shown in FIG. 6. In these aspects, each motor 60*a*, 60*b* can apply a force to the respective driven roller 28*a*, 28*b* to effect rotation of the driven rollers. As a result, each driven roller 28*a*, 28*b* can be rotated at different speeds allowing for different feed rates of the backing materials as the materials pass through the disclosed system, as further disclosed herein.

Figure 1B:
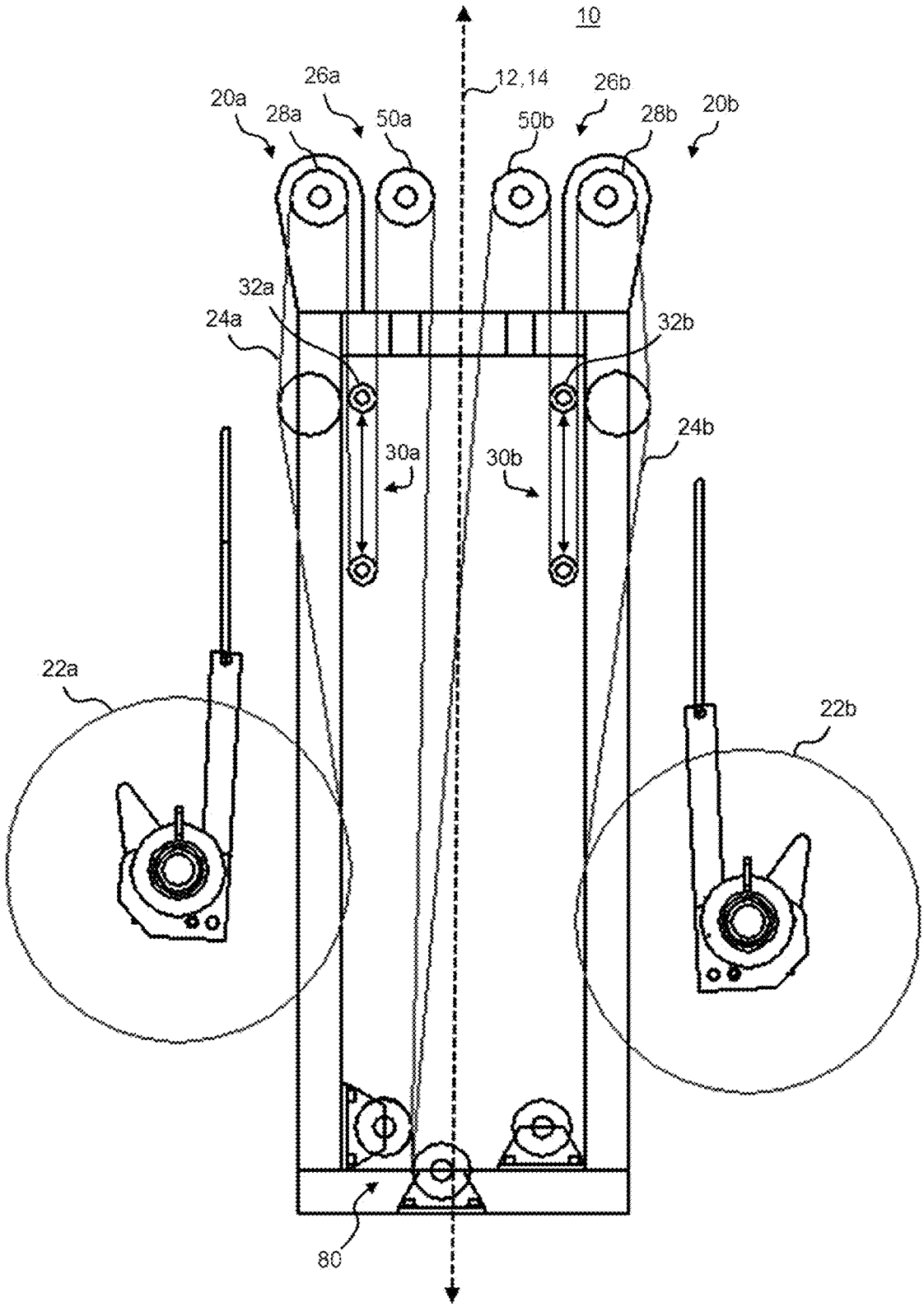
FIG. 1B is a cross-sectional side view of another exemplary system for pre-tensioning backing materials, as disclosed herein.
Figure 2A:
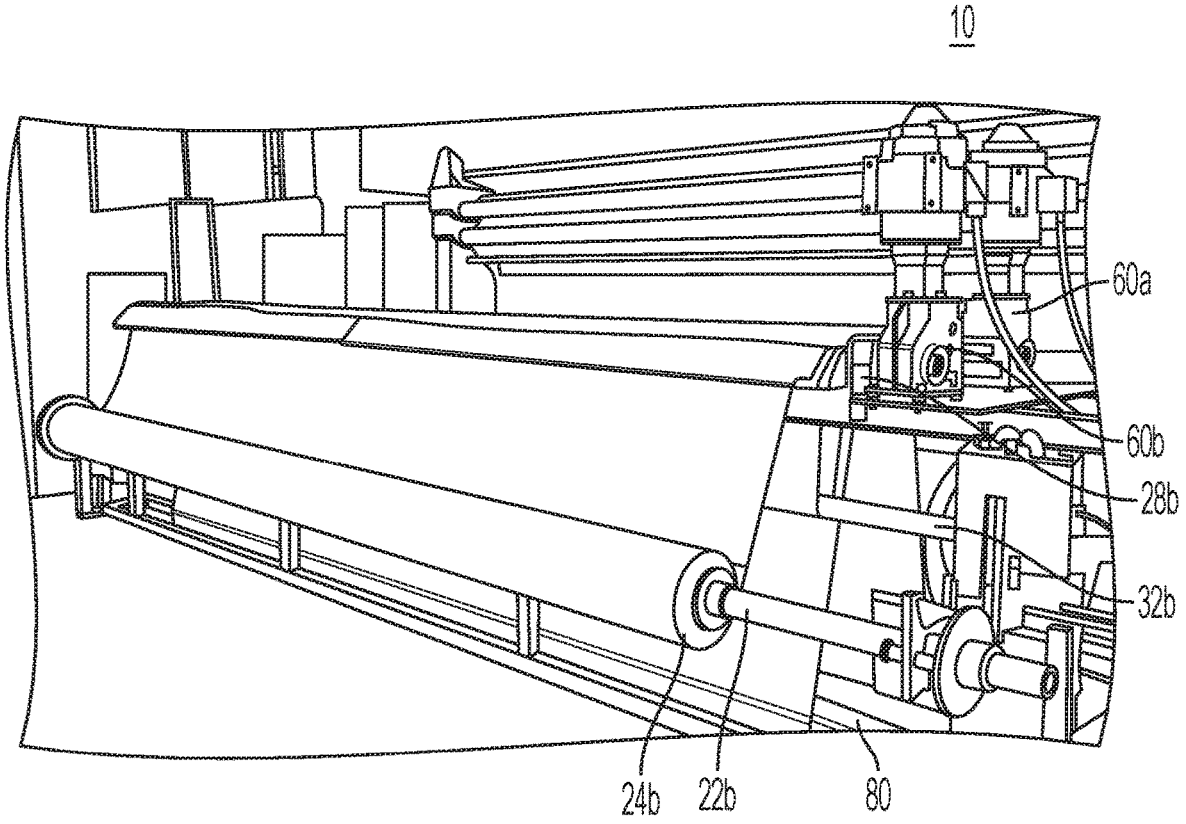
FIG. 2A is an image depicting an exemplary system for pre-tensioning backing materials, with the system positioned in proximity to a tufting machine, as disclosed herein.
Figure 2B:
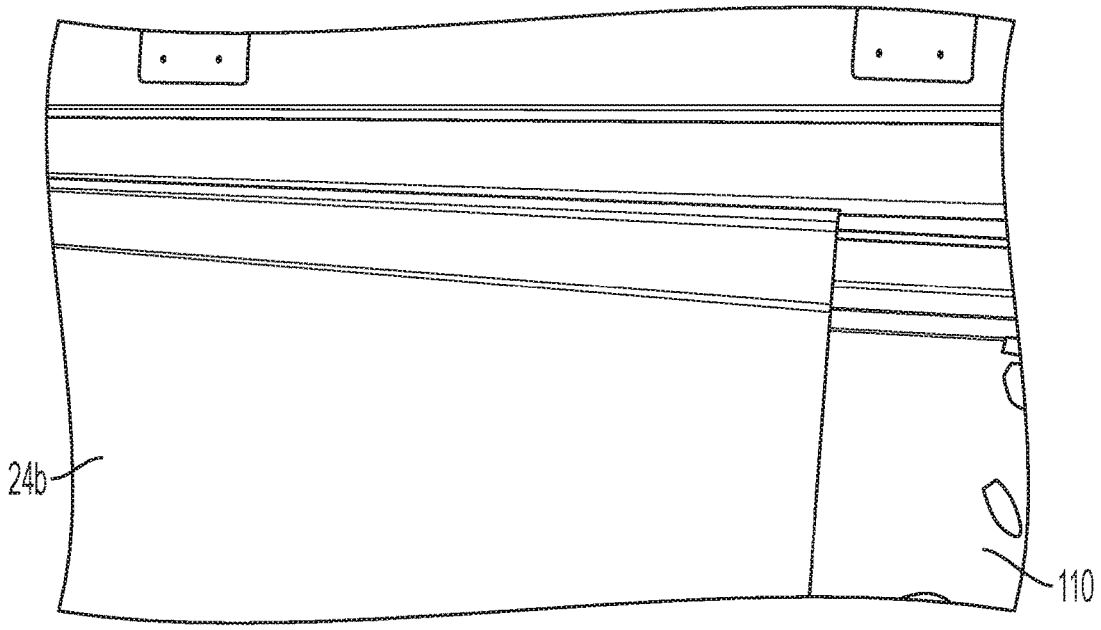
FIG. 2B is a close-up image depicting a backing material entering the tufting machine following pre-tensioning in the system of FIG. 2A, as disclosed herein. As depicted, the backing material does not have any wrinkles (pleats) as it enters the tufting machine.
Figure 4:
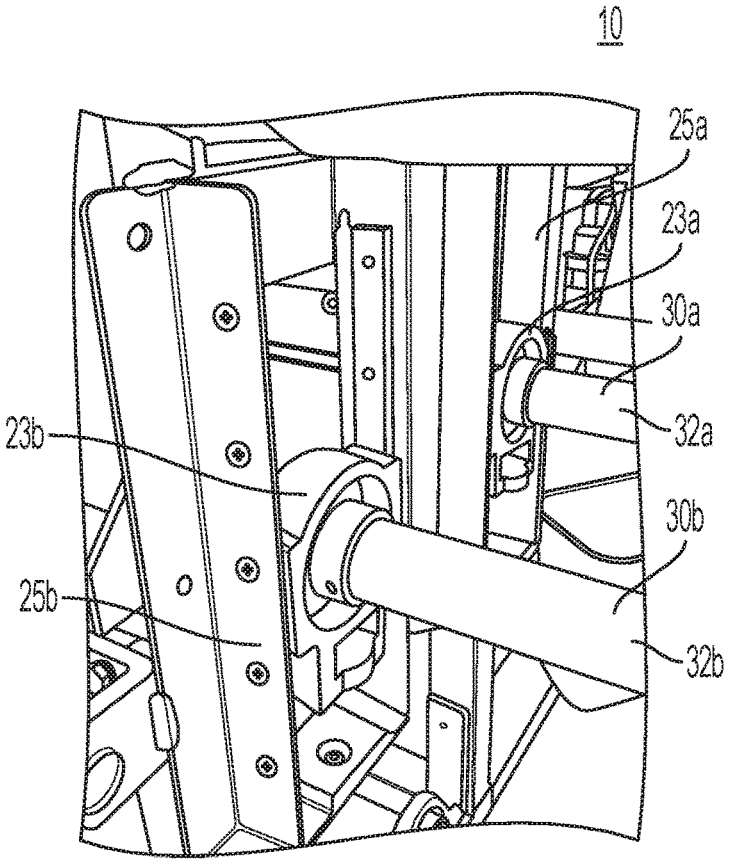
FIG. 4 is an image providing a perspective view of exemplary compensators (e.g., dual dancers) positioned in take-up frames with bearings, as disclosed herein.

In another exemplary aspect, each roller subassembly 26*a*, 26*b* can comprise a compensator 30*a*, 30*b* (e.g., such as a hollow tube). Optionally, each roller subassembly 26*a*, 26*b* can comprise a plurality of compensators. In these aspects, each compensator 30*a*, 30*b* can be positioned downstream of the respective driven roller 28*a*, 28*b* and configured to receive the backing material 24*a*, 24*b* from the driven roller. Optionally, in some aspects, each compensator 30*a*, 30*b* can be rotatably supported by a bearing 23*a*, 23*b* and carried inside a respective take-up frame 25*a*, 25*b*, as shown in FIG. 4. In another optional aspect, and as shown in FIGS. 1A-1B, 4, and 7, each compensator 30*a*, 30*b* can comprise at least one floating compensator (or "dancer") roller 32*a*, 32*b*. In these optional aspects, each floating compensator roller 32*a*, 32*b* can be configured to receive the backing material 24*a*, 24*b* from its respective driven roller 28*a*, 28*b*. It is contemplated that each compensator 30*a*, 30*b*, optionally, can comprise a plurality of floating compensator rollers that cooperate with each other to receive the backing material from the respective driven roller. FIGS. 1A and 1B depict exemplary system configurations comprising first and second tensioning assemblies 20*a*, 20*b*, each having a floating compensator roller 32*a*, 32*b*. As shown, the floating compensator roller 32*a* of the first tensioning assembly 20*a* can receive the backing material 24*a* from the driven roller 28*a*, and the floating compensator roller 32*b* of the second tensioning assembly 20*b* can receive the backing material 24*b* from the driven roller 28*b*. In these exemplary aspects, each floating compensator roller 32*a*, 32*b* can be configured for vertical movement, and the disclosed system can be configured to maintain the floating compensator rollers within a tolerated zone of movement (i.e., a control limit measured with respect to a selected "use" position of the floating compensator roller) in response to rotation of the respective driven roller 28*a*, 28*b*, as further disclosed herein. FIGS. 1A-1B provide schematic illustrations showing (with the depicted arrows) the vertical movement of each floating compensator roller 32*a*, 32*b*. Optionally, in a starting position, the floating compensator roller can be supported on a frame or stand. As can be appreciated, after the floating compensator roller is lifted off the frame or stand (in response to operation of the tufting machine), the compensator roller can rise toward its "use" position, and the weight of the floating compensator roller can apply tension to the web of backing material that is equal to the weight of the floating compensator roller. Although depicted herein as including two tensioning assemblies having floating compensators, it is contemplated that the system need only include a single tensioning assembly having the compensator and feedback capabilities disclosed herein. Thus, it is contemplated that an individual tensioning assembly 20*a*, 20*b* as disclosed herein can be used in combination with any other conventional tensioning assembly.

In exemplary aspects, the selected "use" position and the tolerated zone of movement (i.e., the control limit) for each respective compensator roller can be selectively adjusted for a given tufting process based upon a variety of variables, including, for example and without limitation, the specific configuration of the tensioning assembly, the specific backing material used, selected parameter tolerances (e.g., a tolerance for tension variation), the total range of vertical movement of the compensator rollers, and the like. In further exemplary aspects, it is contemplated that the tolerated zone of movement (both above and below the selected "use" position) can be defined by vertical movement about and between an uppermost position and a lowermost position. It is contemplated that the uppermost position and the lowermost position of the tolerated zone of movement can both be positioned vertically above the starting position. It is further contemplated that the tolerated zone of movement can have a vertical dimension corresponding to the vertical separation (if any) between the uppermost position and the lowermost position. In some optional aspects, the vertical dimension of the tolerated zone of movement can effectively be zero. In these aspects, the compensator roller can be maintained at a selected vertical position, and any variation from that selected vertical position can cause the compensator roller to fall outside the tolerated zone of movement. In other optional aspects, the vertical dimension of the tolerated zone of movement (i.e., the vertical separation between the uppermost position and the lowermost position within the tolerated zone of movement) can range from about $1/32^{nd}$ inch to about 36 inches, from about $1/16^{th}$ inch to about 24 inches, or from about $1/8^{th}$ inch to about 18 inches. In other exemplary aspects, the vertical dimension of the tolerated zone of movement can range from about $1/32^{nd}$ inch to about 12 inches or from about $1/16^{th}$ inch to about 3 inches. In still further examples, the vertical dimension of the tolerated zone of movement can range from about $1/16^{th}$ inch to about 1 inch, from about $1/8^{th}$ inch to about 3/4 inch, or from about $1/4^{th}$ inch to about 1/2 inch. However, it is understood that any desired vertical dimension of the tolerated zone of movement (i.e., any desired vertical separation between the uppermost position and the lowermost position) can be used. Optionally, the "use" position of the compensator roller can correspond to a vertical position that is evenly spaced from the uppermost and lowermost positions of the tolerated zone of movement. Alternatively, the "use" position of the compensator roller can correspond to a vertical position that is closer to the uppermost position than to the lowermost position or to a vertical position that is closer to the lowermost position than to the uppermost position. During use of the tufting machine, it is contemplated that the total (maximum) range of vertical movement of each compensator (both within and outside the desired/tolerated zone of movement) can be from about 1 foot to about 5 feet or from about 2 feet to about 4 feet, or, more preferably, can be about 3 feet.

In another exemplary aspect, each roller subassembly 26*a*, 26*b* of the first and second tensioning assemblies 20*a*, 20*b* can also comprise an idler roller 50*a*, 50*b*, respectively. Each idler roller 50*a*, 50*b* can be configured to receive the backing material from the respective compensator 30*a*, 30*b*. Thus, in use, it is contemplated that the compensator rollers 32*a*, 32*b* can "float" between the driven rollers 28*a*, 28*b* and the idler rollers 50*a*, 50*b*. Optionally, it is contemplated that each idler roller can be positioned at the same or substantially the same height as the corresponding driven roller that is positioned upstream of the idler roller.

In a further exemplary aspect, the system 10 for pretensioning backing materials of a tufted product can comprise a guide assembly 80 configured to simultaneously receive the tensioned backing materials 24*a*, 24*b* from the first and second tensioning assemblies 20*a*, 20*b* and guide the materials to the tufting machine. Optionally, the guide assembly can comprise a plurality of guide rollers that cooperate with each other to guide the backing materials 24*a*, 24*b* to the tufting machine. However, it is understood that the guide assembly can comprise any component or combination of components that is conventionally used to transport a backing material from a tensioning assembly to a tufting machine. In these aspects, the guide assembly 80 can cooperate with each roller subassembly 26*a*, 26*b* to maintain the tension of the respective backing material 24*a*, 24*b*. It is contemplated that the desired tension of the backing material 24*a* exiting the first tensioning assembly 20*a* can be equal or substantially equal to the desired tension of the backing material 24*b* exiting the second tensioning assembly 20*b*. Optionally, however, it is also contemplated that the desired tension of the backing material 24*a* exiting the first tensioning assembly 20*a* can be unequal to the desired tension of the backing material 24*b* exiting the second tensioning assembly 20*b*, as further disclosed herein. In these various aspects, it is contemplated that the guide assembly 80 can be configured to position the tensioned backing materials 24*a*, 24*b* in contact with each other. It is further contemplated that the guide assembly 80 can be positioned to provide sufficient clearance from the floor surface for the tensioned backing materials to freely pass to the tufting machine.

Figure 5:
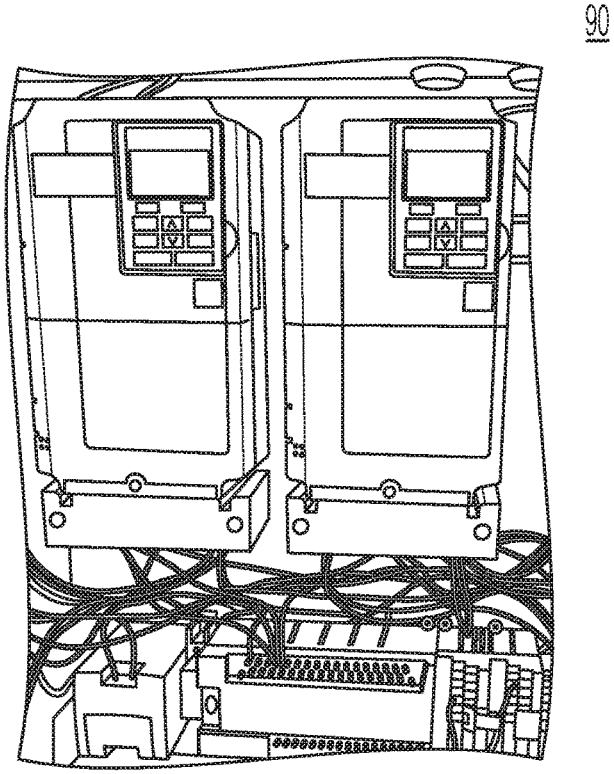
FIG. 5 is an image depicting an exemplary system controller (e.g., a control panel), with drives and programmable logic controllers, as disclosed herein.
Figure 11A:
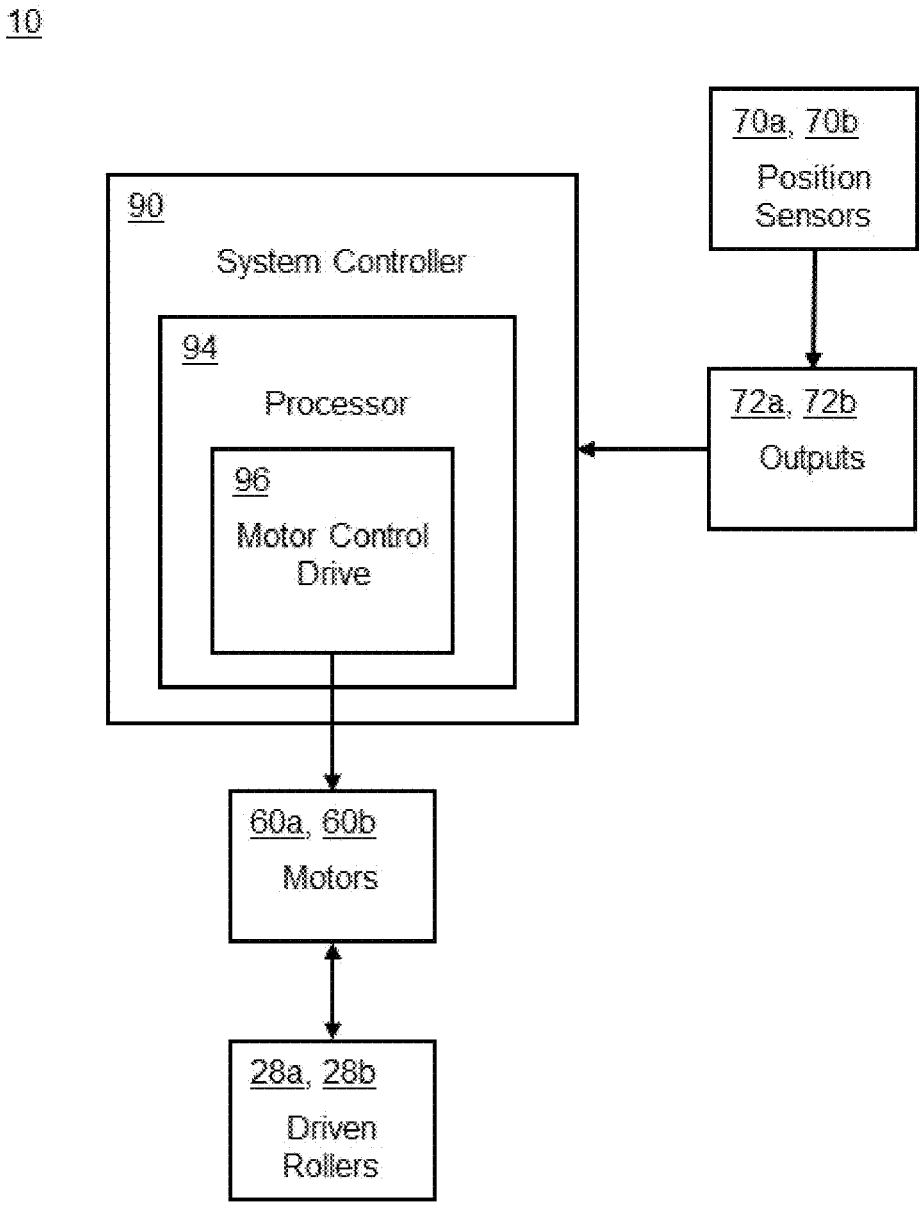
FIG. 11A is a schematic diagram of an exemplary system for pre-tensioning backing materials using feedback from position sensors, as disclosed herein.
Figure 11B:
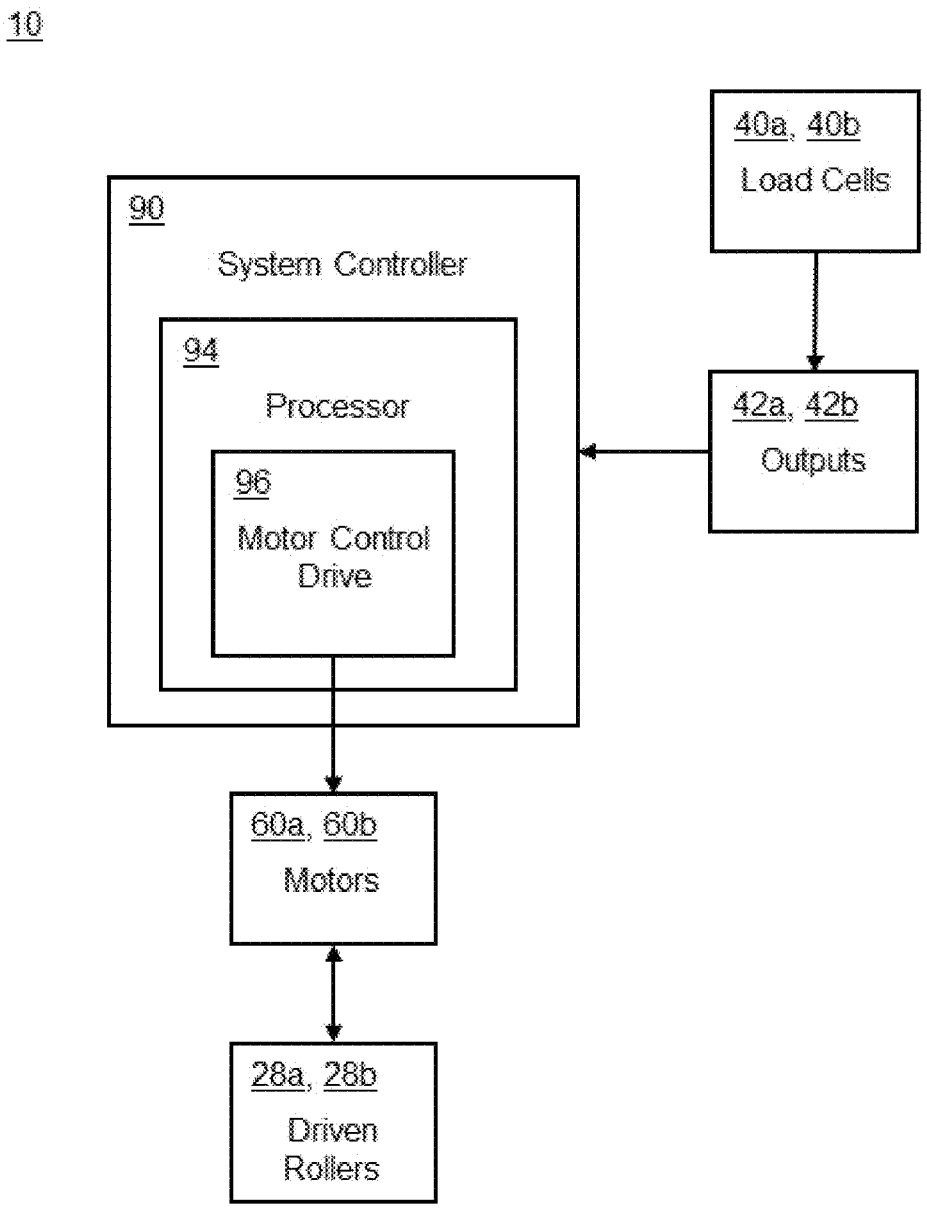
FIG. 11B is a schematic diagram of an exemplary system for pre-tensioning backing materials using feedback from load sensors, as disclosed herein.

As shown in FIGS. 5 and 11A-11B, the disclosed system 10 can comprise a system controller 90. In a further aspect, the system controller 90 can be communicatively coupled to the motors 60*a*, 60*b* and configured to effect rotation of the driven rollers 28*a*, 28*b*, respectively. The system controller 90 can include a processor 94 (e.g., processing circuitry and hardware), which can be provided as a component of a computing device, such as a personal computer, a laptop computer, a tablet, a smartphone, a programmable logic controller, and the like. In one exemplary non-limiting configuration, the processor 94 of the system controller 90 can comprise at least one programmable logic controller that can be communicatively coupled to the motor 60*a* of the first tensioning assembly 20*a*. Similarly, the processor 94 of the system controller 90 can comprise at least one programmable logic controller that can be communicatively coupled to the motor 60*b* of the second tensioning assembly 20*b*. In these exemplary aspects, it is contemplated that the system controller 90 can be configured to independently control the desired tensions of the backing materials 24*a*, 24*b* exiting the first and second tensioning assemblies 20*a*, 20*b*.

As shown in FIGS. 11A-11B, it is contemplated that the processor 94 of the system controller 90 can comprise a motor control drive 96 for controlling the motors 60*a*, 60*b* of the first and second tensioning assemblies 20*a*, 20*b* that drive the system 10. The motor control drive 96 can control and coordinate the motors 60*a*, 60*b* mounted on the tufting apparatus 100 for driving the backing supply subassemblies 22*a*, 22*b* and the roller subassemblies 26*a*, 26*b* of the system 10. The motor control drive 96 can generate data representing the speed of movement (rotation) of each driven roller 28*a*, 28*b*. Optionally, in some aspects, rather than being provided as a component of the processor 94 of the system controller 90, the motor control drive 96 can be provided as a separate processing unit that optionally includes a second processor, which can be provided as a component of a computing device, such as a personal computer, a laptop computer, a tablet, a smartphone, a programmable logic controller, and the like. In these optional aspects, the processor of the motor control drive can be communicatively coupled to the processor 94 of the system controller 90. In use, the motor control drive 96 can be configured to increase or decrease the speed of rotation of each driven roller 28*a*, 28*b* upon receipt of an output (by the processor 94) indicative of a vertical position of a corresponding compensator or a measured weight or tension of a portion of a backing material as further disclosed herein. An exemplary motor control drive is a YASKAWA A1000 manufactured by Yaskawa America, Inc. of Waukegan, Ill.

Optionally, in another exemplary aspect, and with reference to FIGS. 4, 8A-8F, and 11, each of the first and second tensioning assemblies 20*a*, 20*b* can comprise a position sensor 70*a*, 70*b* that can be communicatively coupled to the system controller 90. Each position sensor 70*a*, 70*b* can be configured to produce an output 72*a*, 72*b* indicative of a location (position) of the respective floating compensator roller 32*a*, 32*b* relative to the vertical axis 12. In these aspects, the system controller 90 can be configured to receive the respective output 72*a*, 72*b* from the position sensor 70*a*, 70*b* and maintain or adjust a speed of rotation of the driven roller 28*a*, 28*b* based upon the output of the position sensor. Within each of the first and second tensioning assemblies 20*a*, 20*b*, the driven roller 28*a*, 28*b* can be positioned above the floating compensator roller 32*a*, 32*b* relative to the vertical axis 12. When the output 72*a*, 72*b* of the respective position sensor 70*a*, 70*b* is indicative of a location of the respective floating compensator roller 32*a*, 32*b* that is at or between the uppermost and lowermost positions of the tolerated range of motion (i.e., within the vertical dimension of the tolerated range of motion and within the control limit of the floating compensator roller), the system controller 90 can be configured to maintain the speed of rotation of the associated driven roller 28*a*, 28*b* at a constant level (rpm). If the location of the floating compensator roller 32*a*, 32*b* falls below the lowermost position of the tolerated range of motion or rises above the uppermost position of the tolerated range of motion, then the system controller 90 can be configured to adjust the rotational speed of the respective driven roller 28*a*, 28*b*. More particularly, when the output 72*a* of the position sensor 70*a* of the first tensioning assembly 20*a* is indicative of a position that is below the lowermost position of the tolerated range of motion of the floating compensator roller 32*a* relative to the vertical axis 12, the system controller 90 can be configured to decrease the speed of rotation of the driven roller 28*a* of the first tensioning assembly, thereby providing material to the floating compensator roller 32*a* at a slower rate and allowing the floating compensator roller to rise vertically. Similarly, when the output 72*b* of the position sensor 70*b* of the second tensioning assembly 20*b* is indicative of a position that is below the lowermost position of the tolerated range of motion of the floating compensator roller 32*b* relative to the vertical axis 12, the system controller 90 can be configured to decrease the speed of rotation of the driven roller 28*b* of the second tensioning assembly, thereby providing material to the floating compensator roller 32*b* at a slower rate and allowing the floating compensator roller to rise vertically. On the other hand, when the output 72*a* of the position sensor 70*a* of the first tensioning assembly 20*a* is indicative of a position that is higher than the uppermost position of the tolerated range of motion of the floating compensator roller 32*a* relative to the vertical axis 12, the system controller 90 can be configured to increase the speed of rotation of the driven roller 28*a* of the first tensioning assembly 20*a*, thereby providing material to the floating compensator roller 32*a* at a faster rate and allowing the floating compensator roller to fall vertically. Additionally, when the output 72*b* of the position sensor 70*b* of the second tensioning assembly 20*b* is indicative of a position that is higher than the uppermost position of the tolerated range of motion of the floating compensator roller 32*b* relative to the vertical axis 12, the system controller 90 can be configured to increase the speed of rotation of the driven roller 28*b* of the second tensioning assembly 20*b*, thereby providing material to the floating compensator roller 32*b* at a faster rate and allowing the floating compensator roller to fall vertically. In further aspects, in response to adjustment of the speed of rotation of the driven rollers, after a floating compensator roller 32*a*, 32*b* returns to a vertical position between the uppermost and lowermost positions within the tolerated range of motion (i.e., within the control limit), it is contemplated that the system controller 90 can be configured to maintain a selected rate of rotation of the corresponding driven roller to maintain the vertical position of the floating compensator roller between the uppermost and lowermost positions (and thereby maintain a desired tension of the backing material).

Figure 10:
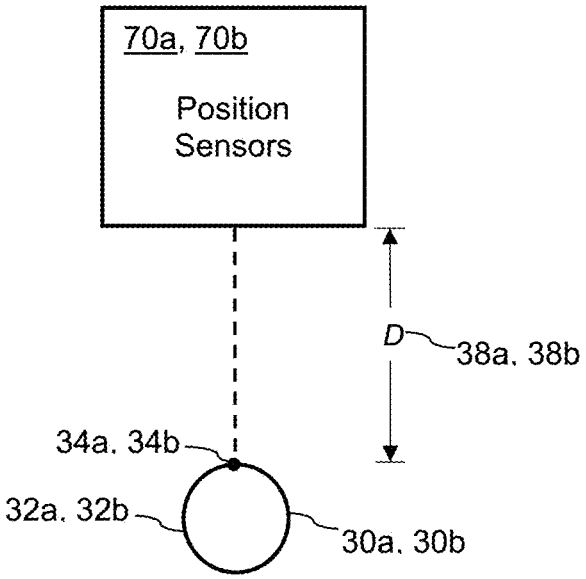
FIG. 10 is a schematic diagram of an exemplary system for pre-tensioning backing materials, showing position sensors that are each configured to determine a distance between the position sensor and a reference point associated with a respective compensator, as disclosed herein.

Optionally, in some aspects and as shown in FIG. 10, the position sensor 70*a*, 70*b* of each tensioning assembly 20*a*, 20*b* can be configured to detect and/or determine a respective distance (D) 38*a*, 38*b* between the position sensor 70*a*, 70*b* and a reference point 34*a*, 34*b* associated with the compensator 30*a*, 30*b* or the floating compensator roller 32*a*, 32*b* of the respective tensioning assembly 20*a*, 20*b* relative to the vertical axis 12. In exemplary aspects, the reference point 34*a*, 34*b* of each compensator 30*a*, 30*b* can be associated with a top surface of each compensator assembly. However, it is contemplated that any suitable reference point location can be used. Optionally, it is contemplated that the reference point 34*a*, 34*b* can be associated with a respective bearing 23*a*, 23*b* mounted about each compensator 30*a*, 30*b* or floating compensator roller 32*a*, 32*b*, as shown in FIG. 4. Optionally, each position sensor 70*a*, 70*b* can be a laser rangefinder as is known in the art. However, it is contemplated that other suitable sensors for measuring length, distance, or range can be used. Such sensors include, without limitation, electronic distance meters, ultrasonic ranging modules, and radar distance measurement instruments as are known in the art. In these aspects, each position sensor 70*a*, 70*b* (e.g., laser rangefinder) can be configured to produce an output indicative of the measured distance 38*a*, 38*b* between the position sensor 70*a*, 70*b* and the reference point 34*a*, 34*b* associated with the respective compensator 30*a*, 30*b* or floating compensator roller 32*a*, 32*b*. In further aspects, the system controller 90 can be configured to receive the output 70*a*, 70*b* from each respective position sensor 70*a*, 70*b* (e.g., laser rangefinder) and maintain or adjust the speed of rotation of the associated driven roller 28*a*, 28*b* based upon the respective output. Although disclosed above as measuring a distance between the position sensor and a reference point on each compensator, it is contemplated that the disclosed position sensors can instead be configured to measure a distance between two different reference points (independent of the sensors) to determine a vertical position of each compensator.

Figure 9A:
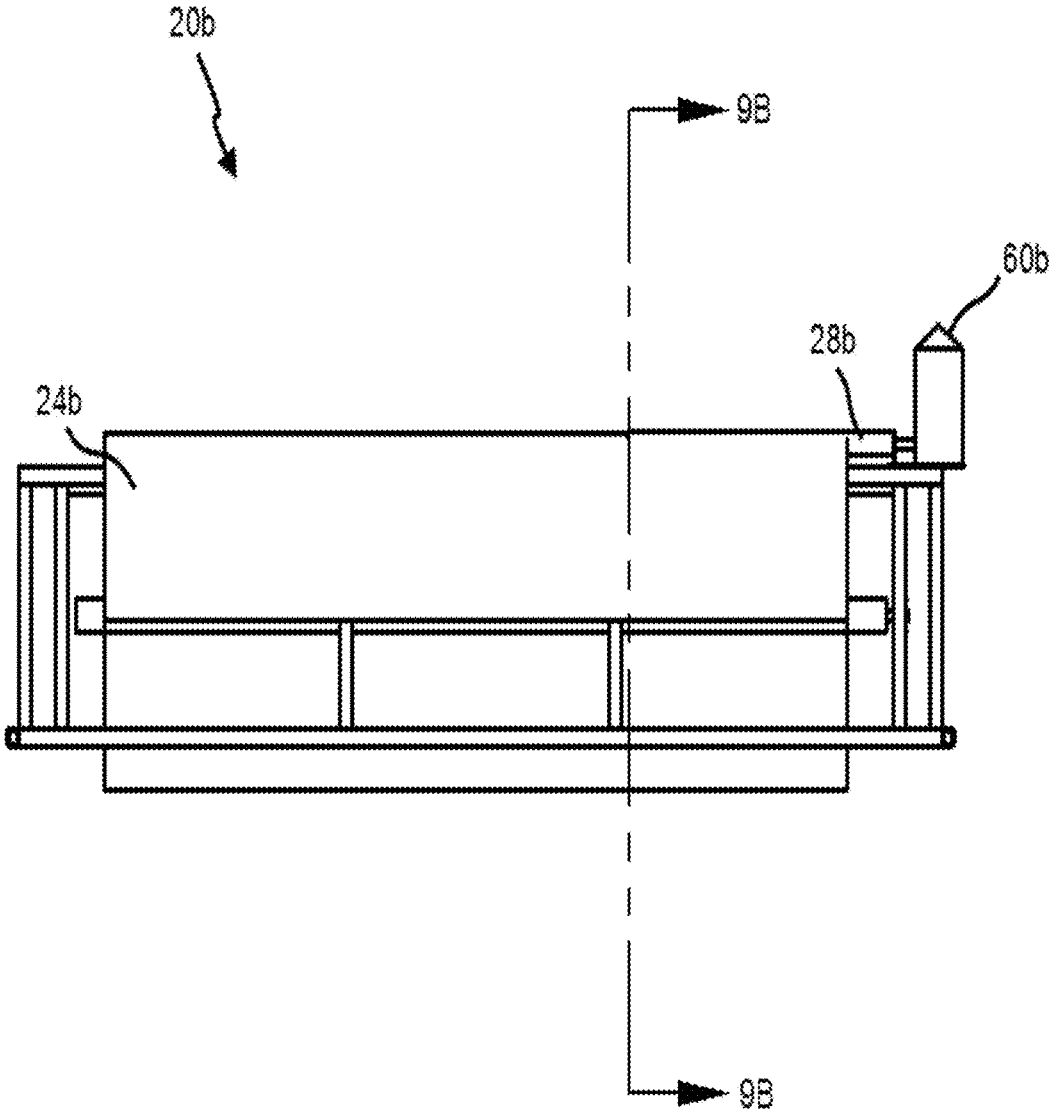
FIG. 9A is a rear view of another exemplary system for pre-tensioning backing materials, as disclosed herein.
Figure 9B:
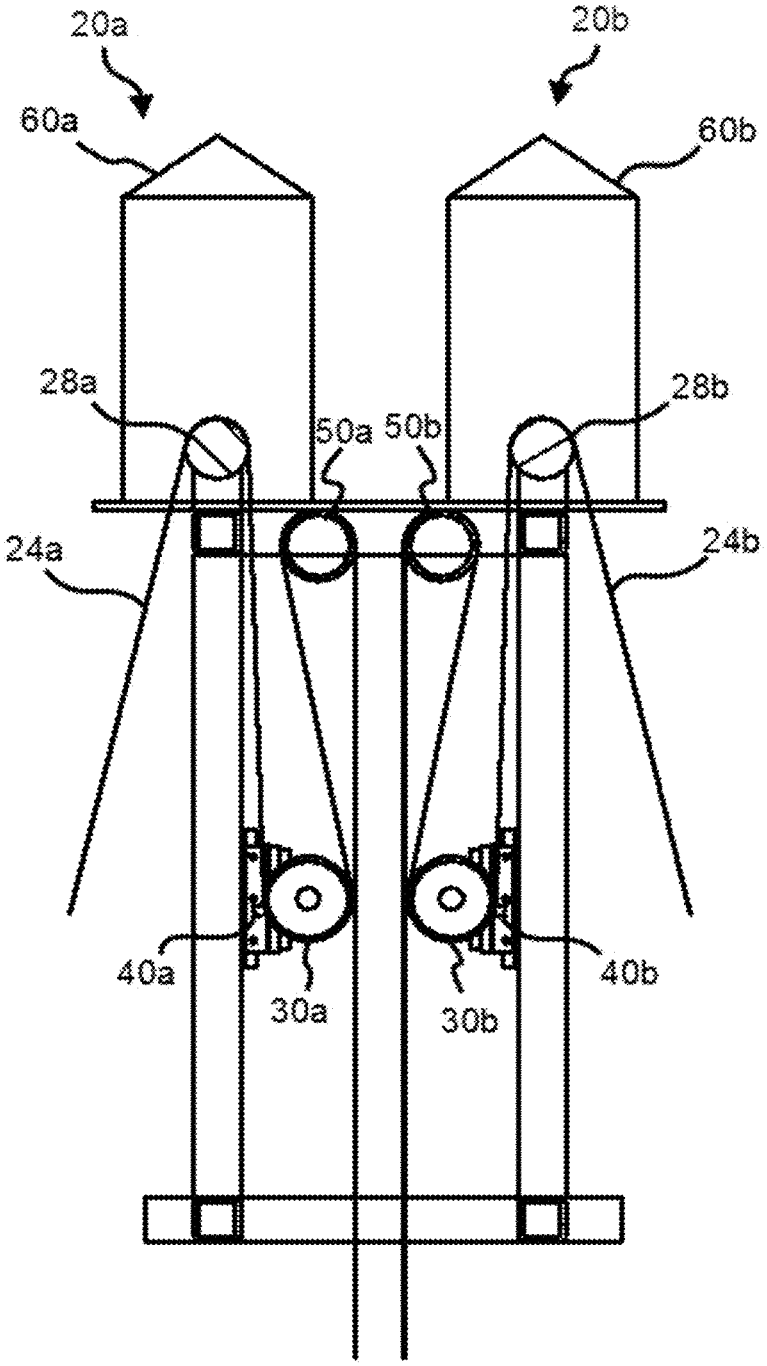
FIG. 9B is a cross-sectional side view of the exemplary system for pre-tensioning backing materials taken along line 9B-9B of FIG. 9A, as disclosed herein.

Optionally, in some exemplary aspects and as shown in FIGS. 9B and 11B, each compensator assembly 30*a*, 30*b* can comprise a load cell 40*a*, 40*b* configured to sense or measure the tension in the backing material 24*a*, 24*b*. In these aspects, rather than including a "floating" compensator roller, the compensator assembly 30*a*, 30*b* can include a load cell 40*a*, 40*b* that is fixed to the frame of the tensioning assembly at a fixed vertical position. As shown in FIG. 9B, it is contemplated that the compensator assembly 30*a*, 30*b* can include a roller that engages and provides for redirection of the flow of backing material. It is further contemplated that the load cell 40*a*, 40*b* of the compensator assembly can define a receptacle for permitting passage of backing material as the backing material enters the compensator assembly 30*a*, 30*b* (e.g., before the backing material reaches the fixed compensator roller). As the backing material passes through the receptacle of the load cell, the load cell is configured to sense or measure the tension in the backing material 24*a*, 24*b*. It is contemplated that any type and/or brand of load cell that is suitable for measuring tension can be used. In exemplary aspects, the load cell 40*a*, 40*b* can include a bearing that receives a portion of the compensator roller, thereby supporting the compensator roller in a fixed vertical position. Although discussed above as being a component of the compensator assembly, it is contemplated that the load cell 40*a*, 40*b* can be positioned at any location between the backing supply subassembly 22*a*, 22*b* and the compensator 30*a*, 30*b*. In further aspects, as shown in FIG. 11B, the load cell can be configured to produce an output 42*a*, 42*b* indicative of the tension of the backing material 24*a*, 24*b*. In still further aspects, the system controller 90 can be configured to receive the output 42*a*, 42*b* from the load cell 40*a*, 40*b* and adjust the speed of rotation of the driven roller 28*a*, 28*b* based upon the output 42*a*, 42*b*, respectively.

Alternatively, in some optional aspects, rather than providing the load cells 40*a*, 40*b* as a component of a compensator assembly, the load cells can be used to weigh the rolls of backing material to decrease tension (by increasing the speed of rotation of the driven rollers) in the backing material as the backing material is being consumed. In these aspects, each load cell 40*a*, 40*b* can be configured to weigh the respective roll of backing material 24*a*, 24*b* positioned on the backing supply subassembly 22*a*, 22*b*. In these aspects, each load cell 40*a*, 40*b* can be positioned at the respective backing supply subassembly 22*a*, 22*b* (proximate the roll of backing material). In further aspects, each load cell 40*a*, 40*b* can be configured to produce an output indicative of the weight of the respective backing material 24*a*, 24*b*. In still further aspects, the system controller 90 can be configured to receive the output from the respective load cell 40*a*, 40*b* and adjust the speed of rotation of the driven roller 28*a*, 28*b* based upon the respective output. Thus, in this configuration, it is contemplated that the compensator assemblies disclosed herein can be eliminated.

Also disclosed herein is a tufting apparatus 100 that can comprise the disclosed system 10 for pre-tensioning backing materials of a tufted product and a tufting machine 110. The tufting machine 110 can be configured to receive the selectively tensioned (optionally, equally or substantially equally tensioned) backing materials 24*a*, 24*b* from the guide assembly 80. In use, the first and second backing materials 24*a*, 24*b* can be provided to the first and second tensioning assemblies 20*a*, 20*b* of the disclosed system 10. More particularly, first and second backing materials 20*a*, 20*b* can be provided to the backing supply subassemblies 22*a*, 22*b*, respectively. Following proper positioning, the first and second backing materials can be fed through the system using the driven rollers, the compensators, and the idler rollers, as further disclosed herein. Each position sensor 70*a*, 70*b* can produce an output 72*a*, 72*b* indicative of a location of the respective floating compensator roller 32*a*, 32*b* relative the vertical axis 12. Each output 70*a*, 70*b* can be received by the system controller 90, which can adjust the speed of rotation of the respective driven roller 28*a*, 28*b* as needed for pre-tensioning of the backing materials. It is contemplated that the system 10 can cause each of the first and second backing materials 24*a*, 24*b* to exit the respective first and second tensioning assemblies 20*a*, 20*b* at any desired tension. Optionally, in some aspects, it is contemplated that the system 10 can cause the first and second backing materials 24*a*, 24*b* to exit the respective first and second tensioning assemblies 20*a*, 20*b* at equal or substantially equal tension. Alternatively, in other aspects, the system 10 can cause the first and second backing materials 24*a*, 24*b* to exit the respective first and second tensioning assemblies 20*a*, 20*b* at unequal tensions. Optionally, it is contemplated that the tension in the first and second backing materials 24*a*, 28*b* exiting the respective first and second tensioning assemblies 20*a*, 20*b* can vary within a range of about −20 lbs. to about 20 lbs., or from about −15 lbs. to about 15 lbs., or from about −10 lbs. to about 10 lbs., or from about −5 lbs. to about 5 lbs. Following pre-tensioning of the first and second backing materials 24*a*, 24*b* by the first and second tensioning assemblies 20*a*, 20*b*, the first and second backing materials can be guided to and received by the guide assembly. The guide assembly can cause the tensioned (i.e., two equally, substantially equally, or unequally tensioned)

backing materials 24*a*, 24*b* to be positioned in contact with each other, as disclosed herein.

In use, it is contemplated that the disclosed systems and methods, when used to pre-tension at least two backing materials at a desired tension, can offer advantages in the areas of customer satisfaction, ease of product installation, and cost of manufacturing. It is contemplated that customer satisfaction can be improved with the improvement of length accuracy by reducing field remakes due to roll shortages. It is further contemplated that delivery times can be shortened. It is further contemplated that ease of installation can improve with the improvement of length accuracy and the reduction of backing wrinkles (pleats) by reducing the time it takes to install each roll of tufted product. It is further contemplated that the cost of manufacturing can be improved by increasing raw material yields, which can be realized in the reduction of waste produced in length overruns and the reduction of off-quality backing wrinkles (pleats).

Exemplary Aspects

In view of the described devices, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A system for pre-tensioning backing materials of a tufted product, comprising: at least first and second tensioning assemblies, wherein each tensioning assembly comprises: a backing supply subassembly configured to support a backing material; and a roller subassembly configured to effect movement of the backing material and comprising: a driven roller positioned downstream of the backing supply subassembly and configured to pull the backing material from the backing supply subassembly, and a compensator positioned downstream of the driven roller and configured to receive the backing material from the driven roller, wherein the roller subassembly is configured to maintain a desired tension of the backing material; and a guide assembly configured to simultaneously receive the tensioned backing materials from the first and second tensioning assemblies, wherein the guide assembly is configured to position the tensioned backing materials in contact with each other.

Aspect 2: The system of aspect 1, wherein the roller subassembly of each of the first and second tensioning assemblies further comprises an idler roller configured to receive the backing material from the compensator.

Aspect 3: The system of aspect 1 or aspect 2, wherein the first and second tensioning assemblies further comprise respective motors, and wherein the system further comprises a system controller that is communicatively coupled to the motors of the first and second tensioning assemblies and configured to effect rotation of the driven rollers of the first and second tensioning assemblies.

Aspect 4: The system of aspect 3, wherein the compensator of each of the first and second tensioning assemblies comprises a floating compensator roller configured for vertical movement, wherein the system controller is configured to selectively adjust rotation of the driven rollers of the first and second tensioning assemblies to maintain a vertical position of each floating compensator roller between an uppermost position and a lowermost position of a tolerated range of motion for the floating compensator roller.

Aspect 5: The system of aspect 4, wherein each of the first and second tensioning assemblies comprises a position sensor that is communicatively coupled to the system controller, wherein the position sensor of each of the first and second tensioning assemblies is configured to produce an output indicative of a location of the floating compensator roller of the tensioning assembly relative to a vertical axis.

Aspect 6: The system of aspect 5, wherein the system controller is configured to receive the outputs from the position sensors of the first and second tensioning assemblies, and wherein the system controller is configured to maintain or adjust a speed of rotation of the driven roller of each of the first and second tensioning assemblies based upon the outputs of the position sensors.

Aspect 7: The system of aspect 6, wherein, within each of the first and second tensioning assemblies, the driven roller is positioned above the floating compensator roller relative to the vertical axis.

Aspect 8: The system of aspect 7, wherein, when the output of the position sensor of the first tensioning assembly is indicative of a location of the floating compensator roller that is between the uppermost position and the lowermost position of the tolerated range of motion, the system controller is configured to maintain the speed of rotation of the driven roller of the first tensioning assembly, and wherein, when the output of the position sensor of the second tensioning assembly is indicative of a location of the floating compensator roller that is between the uppermost position and the lowermost position of the tolerated range of motion, the system controller is configured to maintain the speed of rotation of the driven roller of the second tensioning assembly.

Aspect 9: The system of aspect 7 or aspect 8, wherein, when the output of the position sensor of the first tensioning assembly is indicative of a position that is below the lowermost position of the tolerated range of motion of the floating compensator roller relative to the vertical axis, the system controller is configured to decrease the speed of rotation of the driven roller of the first tensioning assembly, and wherein, when the output of the position sensor of the second tensioning assembly is indicative of a position that is below the lowermost position of the tolerated range of motion of the floating compensator roller relative to the vertical axis, the system controller is configured to decrease the speed of rotation of the driven roller of the second tensioning assembly.

Aspect 10: The system of any one of aspects 7-9, wherein, when the output of the position sensor of the first tensioning assembly is indicative of a position that is higher than the uppermost position of the tolerated range of motion of the floating compensator roller relative to the vertical axis, the system controller is configured to increase the speed of rotation of the driven roller of the first tensioning assembly, and wherein, when the output of the position sensor of the second tensioning assembly is indicative of a position that is higher than the uppermost position of the tolerated range of motion of the floating compensator roller relative to the vertical axis, the system controller is configured to increase the speed of rotation of the driven roller of the second tensioning assembly.

Aspect 11: The system of any one of aspects 5-10, wherein the position sensor of each tensioning assembly is a laser rangefinder that is configured to determine a distance between the position sensor and a reference point associated with the floating compensator roller of the tensioning assembly.

Aspect 12: The system of any one of aspects 1-3, wherein the compensator of each of the first and second tensioning assemblies comprises a load cell configured to produce an output indicative of a tension of the backing material.

Aspect 13: The system of aspect 12, wherein the system controller is configured to receive the output from the load cell of each of the first and second tensioning assemblies, and wherein the system controller is configured to adjust a speed of rotation of the driven roller of each of the first and second tensioning assemblies based upon the output of the load cell.

Aspect 14: The system of any one of aspects 3-13, wherein the system controller comprises: at least one programmable logic controller communicatively coupled to the motor of the first tensioning assembly; and at least one programmable logic controller communicatively coupled to the motor of the second tensioning assembly.

Aspect 15: The system of any one of aspects 3-14, wherein the system controller is configured to independently control the desired tension of the backing material exiting each of the first and second tensioning assemblies.

Aspect 16: The system of any one of the preceding aspects, wherein the first and second tensioning assemblies are arranged symmetrically about a plane containing a vertical axis.

Aspect 17: A tufting apparatus comprising: a system for pre-tensioning backing materials of a tufted product as recited in any one of aspects 1-16; and a tufting machine configured to receive the tensioned backing materials from the guide assembly of the system.

Aspect 18: The tufting apparatus of aspect 17, wherein the first and second tensioning assemblies further comprise respective motors, and wherein the system further comprises a system controller that is communicatively coupled to the motors of the first and second tensioning assemblies and configured to effect rotation of the driven rollers of the first and second tensioning assemblies.

Aspect 19: The tufting apparatus of aspect 18, wherein each of the first and second tensioning assemblies comprises a position sensor that is communicatively coupled to the system controller, wherein the position sensor of each of the first and second tensioning assemblies is configured to produce an output indicative of a location of the compensator of the tensioning assembly relative to a vertical axis, wherein the system controller is configured to receive the outputs from the position sensors of the first and second tensioning assemblies, and wherein the system controller is configured to maintain or adjust a speed of rotation of the driven roller of each of the first and second tensioning assemblies based upon the outputs of the position sensors.

Aspect 20: A method of pre-tensioning backing materials of a tufted product, comprising: providing first and second backing materials to the first and second tensioning assemblies of a system as recited in any one of aspects 1-16; using the system to cause the first and second backing materials to exit the first and second tensioning assemblies at the desired tension; and using the system to position the tensioned backing materials in contact with each other.

All publications and patent applications mentioned in the specification are indicative of the level of those skilled in the art to which this invention pertains. All publications and patent applications are herein incorporated by reference to the same extent as if each individual publication or patent application was specifically and individually indicated to be incorporated by reference.

Although the foregoing invention has been described in some detail by way of illustration and example for purposes of clarity of understanding, certain changes and modifications may be practiced within the scope of the appended claims.

What is claimed is:

1. A system for pre-tensioning backing materials of a tufted product, comprising:

at least first and second tensioning assemblies, wherein each tensioning assembly comprises:

a backing supply subassembly configured to support a backing material; and a roller subassembly configured to effect movement of the backing material and comprising:

a driven roller positioned downstream of the backing supply subassembly and configured to pull the backing material from the backing supply subassembly, and a compensator positioned downstream of the driven roller and configured to receive the backing material from the driven roller, wherein the roller subassembly is configured to maintain a desired tension of the backing material; and a guide assembly configured to simultaneously receive the tensioned backing materials from the first and second tensioning assemblies, wherein the guide assembly is configured to position the tensioned backing materials in contact with each other.

2. The system of claim 1, wherein the roller subassembly of each of the first and second tensioning assemblies further comprises an idler roller configured to receive the backing material from the compensator.

3. The system of claim 1, wherein the first and second tensioning assemblies further comprise respective motors, and wherein the system further comprises a system controller that is communicatively coupled to the motors of the first and second tensioning assemblies and configured to effect rotation of the driven rollers of the first and second tensioning assemblies.

4. The system of claim 3, wherein the compensator of each of the first and second tensioning assemblies comprises a floating compensator roller configured for vertical movement, wherein the system controller is configured to selectively adjust rotation of the driven rollers of the first and second tensioning assemblies to maintain a vertical position of each floating compensator roller between an uppermost position and a lowermost position of a tolerated range of motion for the floating compensator roller.

5. The system of claim 4, wherein each of the first and second tensioning assemblies comprises a position sensor that is communicatively coupled to the system controller, wherein the position sensor of each of the first and second tensioning assemblies is configured to produce an output indicative of a location of the floating compensator roller of the tensioning assembly relative to a vertical axis.

6. The system of claim 5, wherein the system controller is configured to receive the outputs from the position sensors of the first and second tensioning assemblies, and wherein the system controller is configured to maintain or adjust a speed of rotation of the driven roller of each of the first and second tensioning assemblies based upon the outputs of the position sensors.

7. The system of claim 6, wherein, within each of the first and second tensioning assemblies, the driven roller is positioned above the floating compensator roller relative to the vertical axis.

8. The system of claim 7, wherein, when the output of the position sensor of the first tensioning assembly is indicative of a location of the floating compensator roller that is between the uppermost position and the lowermost position of the tolerated range of motion, the system controller is configured to maintain the speed of rotation of the driven roller of the first tensioning assembly, and wherein, when the output of the position sensor of the second tensioning assembly is indicative of a location of the floating compensator roller that is between the uppermost position and the lowermost position of the tolerated range of motion, the system controller is configured to maintain the speed of rotation of the driven roller of the second tensioning assembly.

9. The system of claim 7, wherein, when the output of the position sensor of the first tensioning assembly is indicative of a position that is below the lowermost position of the tolerated range of motion of the floating compensator roller relative to the vertical axis, the system controller is configured to decrease the speed of rotation of the driven roller of the first tensioning assembly, and wherein, when the output of the position sensor of the second tensioning assembly is indicative of a position that is below the lowermost position of the tolerated range of motion of the floating compensator roller relative to the vertical axis, the system controller is configured to decrease the speed of rotation of the driven roller of the second tensioning assembly.

10. The system of claim 7, wherein, when the output of the position sensor of the first tensioning assembly is indicative of a position that is higher than the uppermost position of the tolerated range of motion of the floating compensator roller relative to the vertical axis, the system controller is configured to increase the speed of rotation of the driven roller of the first tensioning assembly, and wherein, when the output of the position sensor of the second tensioning assembly is indicative of a position that is higher than the uppermost position of the tolerated range of motion of the floating compensator roller relative to the vertical axis, the system controller is configured to increase the speed of rotation of the driven roller of the second tensioning assembly.

11. The system of claim 5, wherein the position sensor of each tensioning assembly is a laser rangefinder that is configured to determine a distance between the position sensor and a reference point associated with the floating compensator roller of the tensioning assembly.

12. The system of claim 1, wherein the compensator of each of the first and second tensioning assemblies comprises a load cell configured to produce an output indicative of a tension of the backing material.

13. The system of claim 12, wherein the system controller is configured to receive the output from the load cell of each of the first and second tensioning assemblies, and wherein the system controller is configured to adjust a speed of rotation of the driven roller of each of the first and second tensioning assemblies based upon the output of the load cell.

14. The system of claim 3, wherein the system controller comprises:

at least one programmable logic controller communicatively coupled to the motor of the first tensioning assembly; and at least one programmable logic controller communicatively coupled to the motor of the second tensioning assembly.

15. The system of claim 3, wherein the system controller is configured to independently control the desired tension of the backing material exiting each of the first and second tensioning assemblies.

16. The system of claim 1, wherein the first and second tensioning assemblies are arranged symmetrically about a plane containing a vertical axis.

17. A tufting apparatus comprising:

a system for pre-tensioning backing materials of a tufted product, the system having:

at least first and second tensioning assemblies, wherein each tensioning assembly comprises:

a backing supply subassembly configured to support a backing material; and a roller subassembly configured to effect movement of the backing material and comprising:

a driven roller positioned downstream of the backing supply subassembly and configured to pull the backing material from the backing supply subassembly, and a compensator positioned downstream of the driven roller and configured to receive the backing material from the driven roller, wherein the roller subassembly is configured to maintain a desired tension of the backing material; and a guide assembly configured to simultaneously receive the tensioned backing materials from the first and second tensioning assemblies, wherein the guide assembly is configured to position the tensioned backing materials in contact with each other; and a tufting machine configured to receive the tensioned backing materials from the guide assembly of the system.

18. The tufting apparatus of claim 17, wherein the first and second tensioning assemblies further comprise respective motors, and wherein the system further comprises a system controller that is communicatively coupled to the motors of the first and second tensioning assemblies and configured to effect rotation of the driven rollers of the first and second tensioning assemblies.

19. The tufting apparatus of claim 18, wherein each of the first and second tensioning assemblies comprises a position sensor that is communicatively coupled to the system controller, wherein the position sensor of each of the first and second tensioning assemblies is configured to produce an output indicative of a location of the compensator of the tensioning assembly relative to a vertical axis, wherein the system controller is configured to receive the outputs from the position sensors of the first and second tensioning assemblies, and wherein the system controller is configured to maintain or adjust a speed of rotation of the driven roller of each of the first and second tensioning assemblies based upon the outputs of the position sensors.

20. A method of pre-tensioning backing materials of a tufted product, comprising:

providing first and second backing materials to first and second tensioning assemblies, wherein each tensioning assembly comprises:

a backing supply subassembly configured to support a backing material; and a roller subassembly configured to effect movement of the backing material and comprising:

a driven roller positioned downstream of the backing supply subassembly and configured to pull the backing material from the backing supply subassembly, and a compensator positioned downstream of the driven roller and configured to receive the backing material from the driven roller, wherein the roller subassembly is configured to maintain a desired tension of the backing material; and a guide assembly configured to simultaneously receive the tensioned backing materials from the first and second tensioning assemblies, wherein the guide assembly is configured to position the tensioned backing materials in contact with each other;

using the first and second tensioning assemblies to cause the first and second backing materials to exit the first and second tensioning assemblies at respective desired tensions; and using the first and second tensioning assemblies to position the tensioned backing materials in contact with each other.

* * * * *